United States Patent [19]

McGann et al.

[11] 4,452,159

[45] Jun. 5, 1984

[54] REINFORCING FOR MOLDED SEWING MACHINE FRAME

[75] Inventors: Leo E. McGann, Cranford; Kenneth D. Adams, Madison, both of N.J.

[73] Assignee: The Singer Company, Stamford, Conn.

[21] Appl. No.: 472,450

[22] Filed: Mar. 7, 1983

[51] Int. Cl.[3] ..... D05B 73/00

[52] U.S. Cl. ..... 112/258

[58] Field of Search ..... 112/258, 259, 260

[56] References Cited

U.S. PATENT DOCUMENTS 2,411,459 11/1946 Perkins et al. .
2,791,193 5/1957 Parry .
2,987,021 6/1961 Meier ..... 112/258
3,866,553 2/1975 Adams et al. ..... 112/258
4,193,361 3/1980 Johnson ..... 112/259

*Primary Examiner*—Werner H. Schroeder
*Assistant Examiner*—Andrew M. Falik
*Attorney, Agent, or Firm*—Robert E. Smith; Edward L. Bell

[57] ABSTRACT

A sewing machine bed which, because an open channel is required to accommodate a preassembled operating mechanism module, is reinforced to minimize objectionable deflection by reinforcing ribs formed on a cover plate and rigidly connected to reinforcing bosses on the sewing machine bed when the cover plate is secured thereon.

3 Claims, 1 Drawing Figure

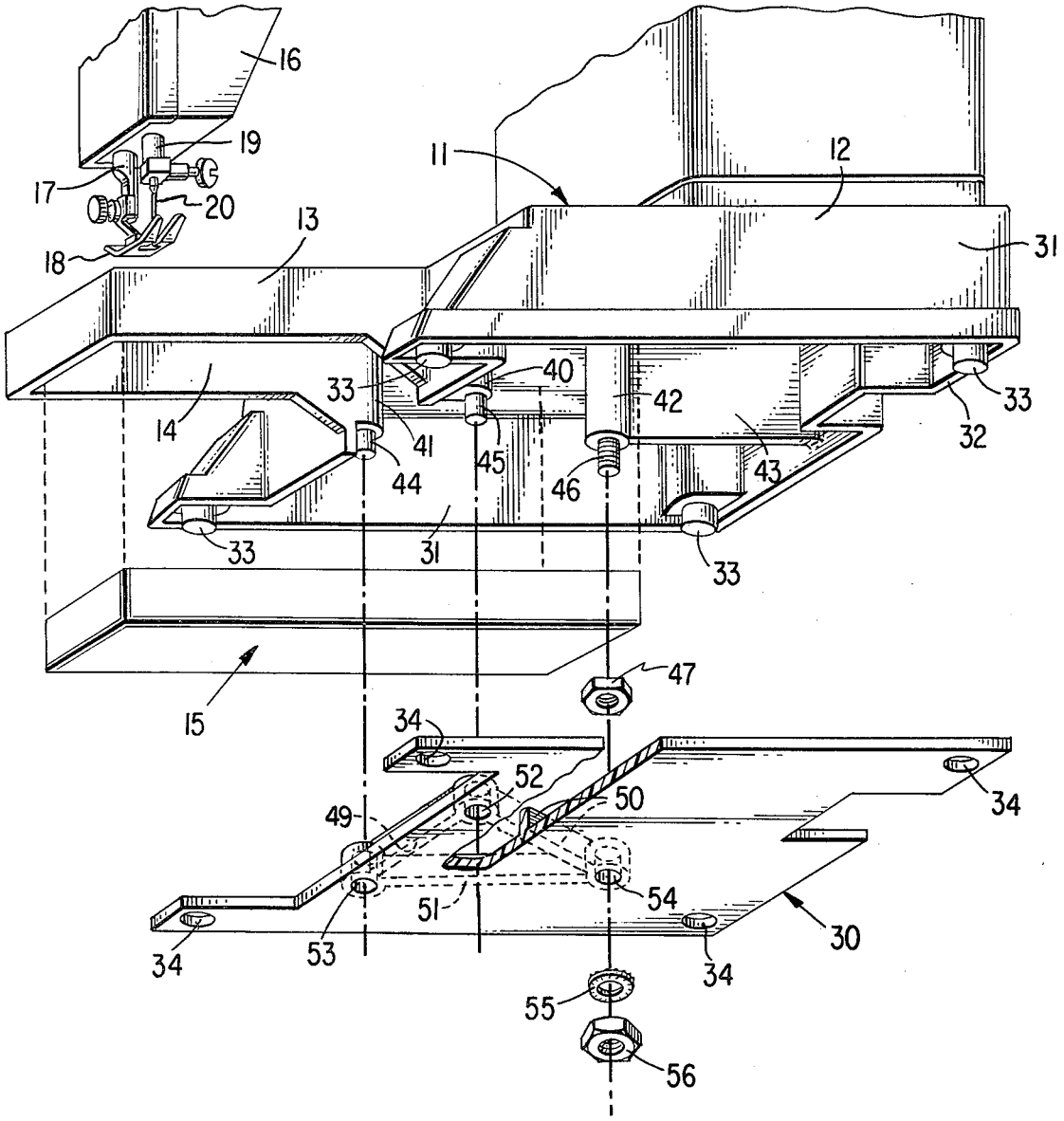
16
19
17
20
18
13
11
12
31
14
33
40
42
41
44
45
46
43
32
33
33
31
33
15
47
34
52
50
49
34
51
54
53
34
34
30
55
56

REINFORCING FOR MOLDED SEWING MACHINE FRAME

DESCRIPTION

BACKGROUND OF THE INVENTION

This invention relates to sewing machine work supporting frame construction, and more particularly to reinforcing means for a molded sewing machine frame designed with an unobstructed channel for accommodation of a preassembled operative mechanism module.

It was conventional in sewing machine frame construction to provide for numerous machining operations after the initial molding or casting of the frame so as to provide for insertion, clearances and support of the various elements of the operating mechanism one by one into the frame. As a result, in conventional sewing machine frame construction, practically unlimited choice was available for the location of integral reinforcing webs, partitions, ribs and the like. Because of the freedom which conventional frame construction provided as to the number and location of integral reinforcing segments, no serious problems arose in preventing objectionable deformation in response to the forces to which the frame was subjected during sewing operation.

With the quest for cost effectiveness in the manufacture and assembly of sewing machines, however, the technique of preassembling sewing machine operating mechanism into modules for insertion bodily into the sewing machine casing is increasingly being utilized. Such modular construction affords double cost savings; i.e., not only is it easier to assemble individual parts into a module than into the often poorly accessible areas within a sewing machine casing, but the number and complexity of machining operations on the sewing machine casing may be reduced. A problem which arises however, is that because clear openings or channels are required to be provided in the sewing machine frame for introduction and accommodation of the preassembled modules of operating mechanism, freedom of location of integral reinforcing ribs and the like is sacrificed.

The U.S. Pat. No. 4,193,361, Mar. 18, 1980, discloses one approach to the solution of this problem. By providing a sewing machine bed construction which is open to the side, somewhat greater freedom is provided in choice of the size and location of the ribs, webs, etc., which are integral parts of the casing. In this referenced patent, the cover is not provided with any particular form for reinforcing purposes and in fact, the cover is not included in the illustrations.

SUMMARY OF THE INVENTION

In accordance with this invention, a sewing machine casing which is formed with a clear opening or channel for the reception of an operating mechanism module is reinforced by webs or ribs which are formed on a detachable cover plate. Means are provided for rigidly connecting the reinforcing ribs to vertical bosses which are located at points particularly subject to deflection on the sewing machine casing, and also to a boss located at a remote anchor point on the casing. One of the rigid attaching means may also serve to maintain the cover plate in place relatively to the machine casing. Preferrably, the anchor point on the machine casing to which the reinforcing ribs on the cover are connected is located in an area within the casing at which integral reinforcing webs may be provided which will not interfere with operating mechanism module accommodation within the casing.

DESCRIPTION OF THE DRAWING

With the above and additional objects and advantages in view, as will hereinafter appear, this invention will be described with reference to a preferred embodiment illustrated in the accompanying drawing which comprises an exploded perspective view of the bed portion of a sewing machine frame, the bottom cover thereof, a generalized representation of a preassembled module including the operating mechanism within the bed, and a fragment of the sewing head including the presser device and needle carried thereby.

DESCRIPTION OF THE INVENTION

Referring to the drawing, 11 indicates the bed portion of a sewing machine frame which includes a base portion 12 from which extends a cantilevered tubular work supporting arm 13. Preferrably, the sewing machine bed is fabricated by a molding process and is open on the underside from which direction the molding dies are drawn.

Numerous vertical webs and ribs may be included in the bed configuration some of which will be described in detail hereinbelow. Within the work supporting arm 13 and contiguous thereto within the base portion 12 of the bed, a continuous channel 14 is provided clear of any transverse ribs or webs for ready accommodation of a preassembled module 15 which includes at least the major elements of the operating mechanism required in the sewing machine bed. Reference is made to the U.S. Pat. No. 4,193,361, Mar. 18, 1980, for a detailed description of one such preassembled module.

Indicated at 16 is a fragment of the sewing head of the sewing machine which is arranged above the work supporting arm 13 and carries a presser bar 17 to which a presser foot 18 is secured and an endwise reciprocatory needle bar 19 to which a needle 20 is affixed.

As is conventional in the sewing machine art, the presser foot 18 is biased toward the work supporting arm 13 to maintain work fabrics in engagement with work feed instrumentalities (not shown) and the needle is reciprocated through the fabrics sustained on the work supporting arm. Both of these devices thus impart forces to the work supporting arm which, for successful sewing machine operation, must be accommodated by the bed frame structure without objectionable deformation.

The problem which arises because of the requirement for providing a clear channel 14 within the bed 11 and the resulting objectionable deformation characteristics of the work supporting arm 13 is obviated in the present invention by the construction of the base portion 12 of the bed frame and the cooperative relation therewith of structure on a bottom cover plate 30 as will now be described.

The base portion 12 of the sewing machine bed 11 is formed with exterior side walls 31 terminating beneath the bed in a substantially continuous rim 32 arranged in a single plane and defining an enclosure within which the substantially planar bottom cover 30 is shaped to fit. Cylindrical support pads 33 project downwardly beyond the plane of the side wall rim 32, and apertures 34 are provided in the bottom cover through which the pads project when the cover is in place beneath the bed.

A series of reinforcing bosses are formed within the base portion 12 of the sewing machine bed frame. These bosses may be independent of each other, that is, they need not be connected to each other by integral webs or the like within the bed frame. The reinforcing bosses, however, are preferrably recessed upwardly of the plane of the rim 32 defined by the exterior side walls, the boss 42 being recessed somewhat more than bosses 40 and 41 for a purpose to be described hereinbelow.

Two of such reinforcing bosses 40 and 41 are formed one on each side of the channel 14 at the juncture of the work supporting bed 13 with the base portion 12 of the bed frame.

A third of the reinforcing bosses 42 is arranged remote from the other reinforcing bosses 40 and 41 within the base portion 12 of the frame and preferrably toward one side of the channel 14. A strengthening web 43 may be provided joining the reinforcing boss 42 and extending parallel to the channel 14 and away from the reinforcing bosses 40 and 41.

Plain cylindrical pins 44 and 45 may be pressed one into each of the reinforcing bosses 40 and 41 while a stud 46 is threaded into reinforcing boss 42. A lock nut 47 on the stud 46 serves to secure the stud rigidly in the boss and preferrably the boss 42 is recessed that amount more than bosses 40 and 41 equal to the thickness of the lock nut 47.

Referring to the illustration of the bottom cover 30 in the drawing, reinforcing ribs 49, 50 and 51 are formed integral with the bottom cover and each extends upwardly an amount substantially equal to that which the reinforcing bosses 40, 41 and the lock nut 47 on boss 42 in the bed are recessed within the rim 32. For providing rigid connection means between the reinforcing ribs 49, 50 and 51 and the bosses 40, 41 and 42, apertures 52, 53 are formed at the diverging extremities of the ribs 50 and 51 for reception of the plain cylindrical pins 44 and 45, respectively, each with an interference fit. At the juncture of the ribs 50 and 51, a through aperture 54 is provided for accommodating the threaded stud 46. A lock washer 55 and nut 56 threaded on the stud 46 may be used to secure the bottom cover rigidly and tightly in place beneath the bed frame 11.

This invention provides a cost effective solution to the problem of control of the deflection of a sewing machine work supporting bed. The bottom cover as well as the bed frame itself, being molded components, may have the reinforcing bosses and reinforcing ribs formed integrally during the molding process and thus, this invention does not involve the manufacture and installation of any major reinforcing members as separate parts. Moreover, the arrangement of components in this invention is compatable with the requirement for provision of clear space channels within the sewing machine frame for accommodation of modules of preassembled operating parts.

It is to be understood that the present disclosure relates to a preferred embodiment of the invention which is for purposes of illustration only, and that various modifications may be made therein without departing from the spirit and scope of the invention as defined in the appended claims.

We claim:

1. A sewing machine frame member including a sewing machine bed comprising a base portion and a work supporting tubular arm cantilevered from said base portion and adapted to have forces applied thereto incident to the use and operation of said sewing machine, spaced bosses on said frame member, one of said spaced bosses located adjacent the juncture of said tubular arm with said base portion, another of said spaced bosses located on said base portion remote from said tubular arm, said spaced bosses subject to deflection in a direction toward and away from each other incident to application of said forces, said frame member formed with an opening between said spaced bosses for accommodation and assembly of sewing mechanism within said frame member, a detachable cover element for said frame member enclosing at least the base portion of said sewing machine frame member, a reinforcing rib carried by said detachable cover element and adapted to span the opening between said spaced deflectable sewing machine frame bosses when said detachable cover element is arranged in place relatively to said sewing machine frame member, and means rigidly connecting said reinforcing rib directly to each of said spaced bosses on said sewing machine frame member, said connecting means also maintaining said cover element in place relatively to said sewing machine frame.

2. A sewing machine frame member construction as set forth in claim 1 in which said spaced bosses include separate bosses located adjacent the juncture of said tubular arm with said base portion and arranged one at each side of said tubular arm, and a single boss located on said base portion remote from said tubular arm, and in which diverging reinforcing ribs are carried by said cover element each adapted to span the opening between said single boss located on said base portion remote from said tubular arm and a respective one of said separate bosses located adjacent the juncture of the tubular arm with the base portion.

3. A sewing machine frame member construction as set forth in claim 1 in which the base portion and tubular arm of said sewing machine bed are open vertically downwardly, in which said opening between said spaced bosses comprises a continuous channel formed in said tubular arm and extending contiguous thereto into said frame base portion for accommodation therein of a preassembled operating mechanism module, and in which said cover element is a bottom cover for said sewing machine bed.

* * * * *